US010265744B2

(12) United States Patent
Chung et al.

(10) Patent No.: US 10,265,744 B2
(45) Date of Patent: Apr. 23, 2019

(54) ROLLING APPARATUS, CONTINUOUS CASTING AND ROLLING APPARATUS AND METHOD

(71) Applicant: POSCO, Pohang-si, Gyeongsangbuk-do (KR)

(72) Inventors: Jea-Sook Chung, Gwangyang-si (KR); Il-Sin Bae, Gwangyang-si (KR); Young-Ju Ko, Gwangyang-si (KR); Kyeong-Mi Park, Gwangyang-si (KR); In-Jae Lee, Gwangyang-si (KR); Choong-Yun Lee, Gwangyang-si (KR); Suk-Cheol Song, Gwangyang-si (KR); Seong-Yeon Kim, Gwangyang-si (KR); Jong-Yeon Hwang, Gwangyang-si (KR); Sang-Hyeon Lee, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 282 days.

(21) Appl. No.: 15/108,551

(22) PCT Filed: Dec. 26, 2013

(86) PCT No.: PCT/KR2013/012178
§ 371 (c)(1),
(2) Date: Jun. 27, 2016

(87) PCT Pub. No.: WO2015/099224
PCT Pub. Date: Jul. 2, 2015

(65) Prior Publication Data

US 2016/0318081 A1 Nov. 3, 2016

(30) Foreign Application Priority Data

Dec. 26, 2013 (KR) ..... 10-2013-0163563

(51) Int. Cl.
*B21B 1/46* (2006.01)
*B22D 11/126* (2006.01)
(Continued)

(52) U.S. Cl.
CPC ..... *B21B 1/463* (2013.01); *B21B 1/26* (2013.01); *B21B 37/74* (2013.01); *B21B 45/004* (2013.01); *B22D 11/126* (2013.01)

(58) Field of Classification Search
CPC ..... B21B 1/463; B21B 45/004; B21B 37/74; B21B 1/26; B22D 11/126
See application file for complete search history.

(56) References Cited

U.S. PATENT DOCUMENTS 5,307,864 A 5/1994 Arvedi et al.
5,542,165 A 8/1996 Coassin et al.
(Continued)

FOREIGN PATENT DOCUMENTS

CN 1104566 A 7/1995
CN 1640568 A 7/2005
(Continued)

OTHER PUBLICATIONS

Office Action in corresponding Russian Patent Application No. 2016130317, dated Aug. 29, 2017 (with full English translation).
(Continued)

*Primary Examiner* — John C Hong
(74) *Attorney, Agent, or Firm* — Morgan Lewis & Bockius LLP

(57) ABSTRACT

A hot rolling device, according to one embodiment of the present invention, may comprise: a cast part supply portion for producing a cast part; a hot roller, linked to the cast part supply portion, for receiving and hot-rolling the cast part; and a heating unit, arranged between the cast part supply portion and the hot roller, for reheating an outer surface
(Continued)

portion in the widthwise direction of the cast part while latent heat is maintained in the center portion of the widthwise direction of the cast part from preheating.

14 Claims, 5 Drawing Sheets

(51) Int. Cl.

| | |
|---|---|
| ***B21B 45/00*** | (2006.01) |
| ***B21B 1/26*** | (2006.01) |
| ***B21B 37/74*** | (2006.01) |

(56) References Cited

U.S. PATENT DOCUMENTS

| | | | |
|---|---|---|---|
| 6,832,432 | B2 | 12/2004 | Bald et al. |
| 8,025,092 | B2 | 9/2011 | Arvedi |
| 8,365,806 | B2 | 2/2013 | Rosenthal et al. |

FOREIGN PATENT DOCUMENTS

| | | | |
|---|---|---|---|
| CN | 101108394 | A | 1/2008 |
| CN | 101272873 | A | 9/2008 |
| JP | 05-293511 | B2 | 11/1993 |
| JP | 2001-276915 | A | 10/2001 |
| JP | 2001-314913 | A | 11/2001 |
| JP | 3581973 | B2 | 10/2004 |
| JP | 2005-161351 | A | 6/2005 |
| JP | 2006-021246 | A | 1/2006 |
| JP | 2008-546833 | A | 12/2008 |
| KR | 10-1990-7001437 | A | 12/1990 |
| KR | 10-2010-0078425 | A | 7/2010 |
| KR | 10-2012-0070247 | A | 6/2012 |
| KR | 10-2013-0075609 | A | 7/2013 |
| KR | 10-2013-0075799 | A | 7/2013 |
| RU | 2216416 | C2 | 11/2003 |
| RU | 2012124897 | A | 12/2013 |

OTHER PUBLICATIONS

Office Action in corresponding Chinese Patent Application No. 201380081905.X, dated Sep. 27, 2017.

Chinese Office Action dated Jan. 22, 2017 in Chinese Patent Application No. 201380081905.X (English translation).

International Search Report dated Sep. 29, 2014 issued in International Patent Application No. PCT/KR2013/012178 (English translation).

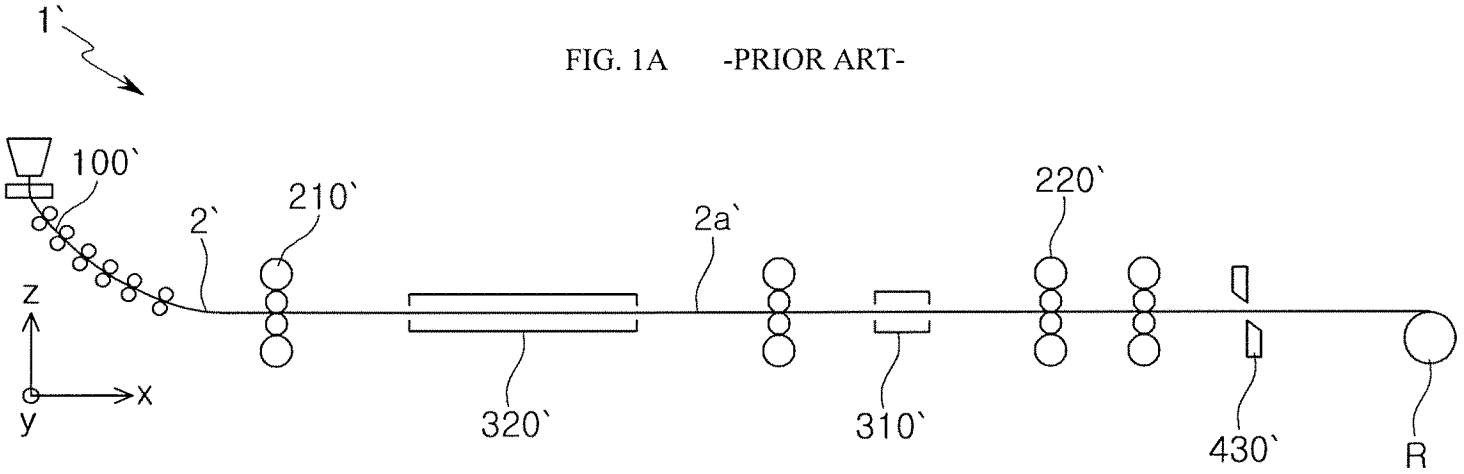
FIG. 1A -PRIOR ART-
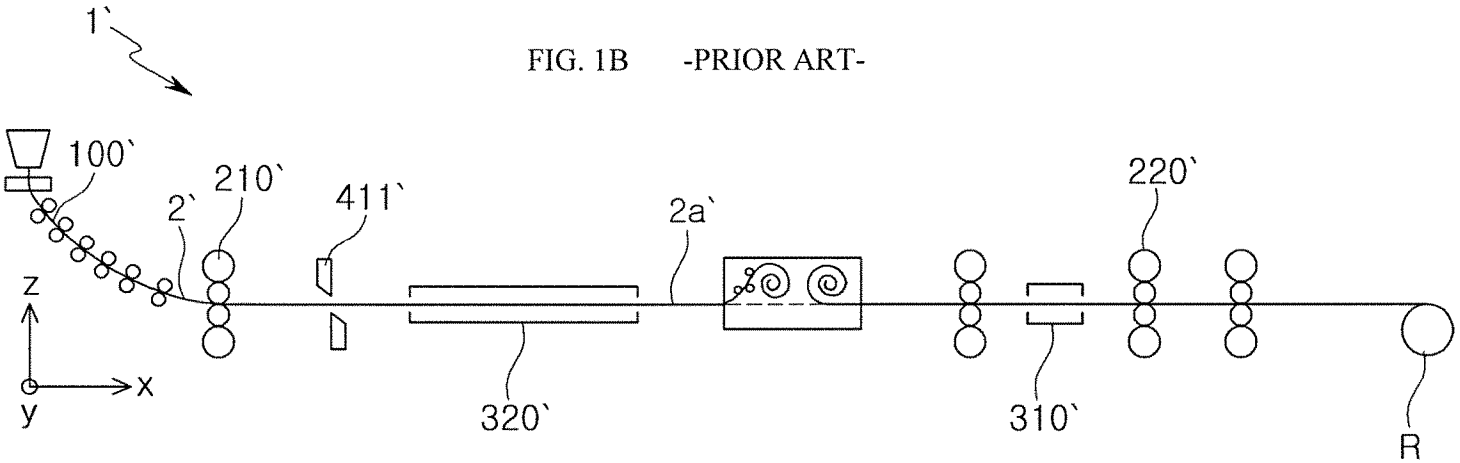
FIG. 1B -PRIOR ART-

【FIG. 5】
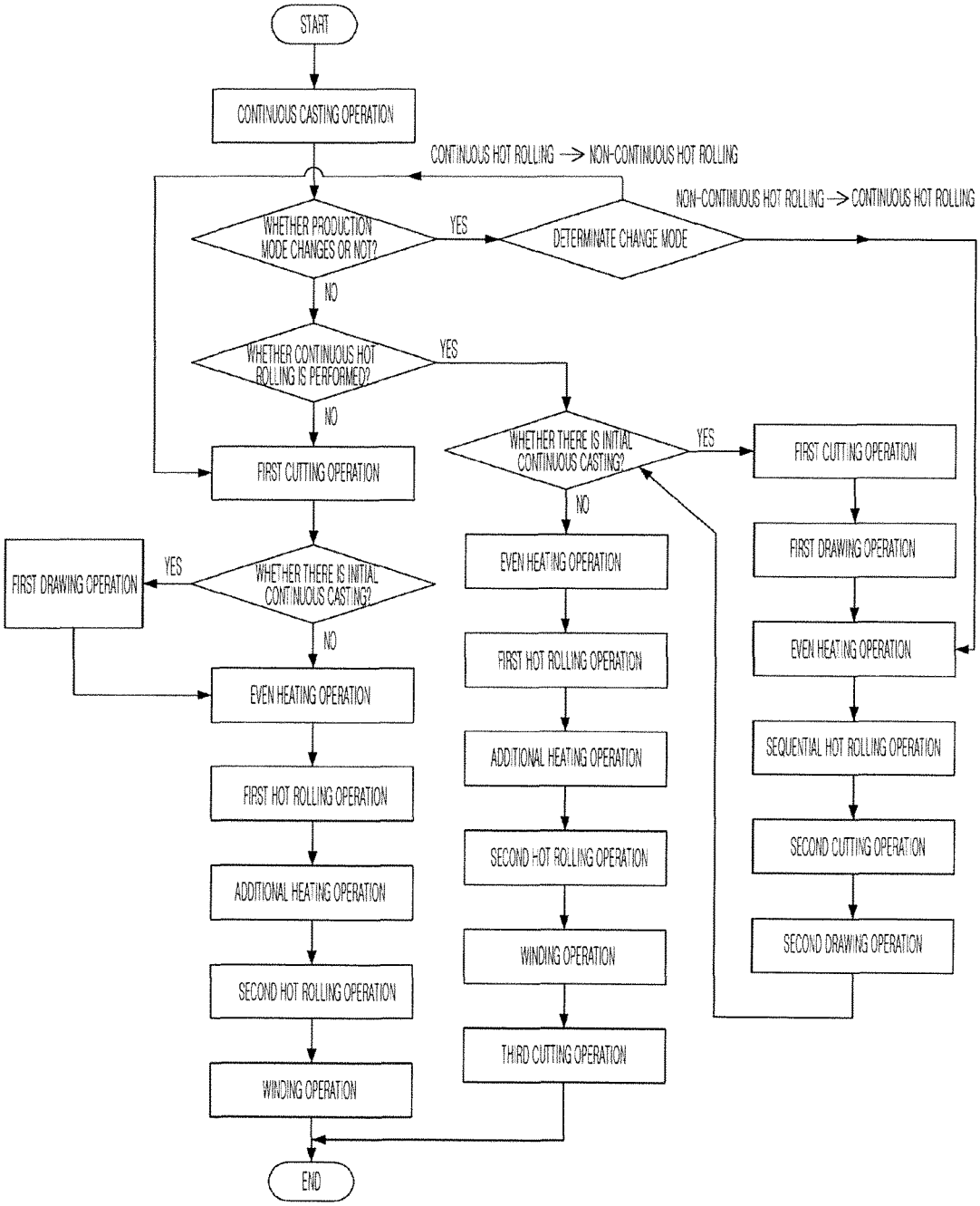

ROLLING APPARATUS, CONTINUOUS CASTING AND ROLLING APPARATUS AND METHOD

RELATED APPLICATIONS

This application is the U.S. National Phase under 35 U.S.C. § 371 of International Application No. PCT/KR2013/012178, filed on Dec. 26, 2013, which in turn claims the benefit of Korean Patent Application Nos. 10-2013-0163563, filed on Dec. 26, 2013, the disclosure of which applications are incorporated by reference herein.

TECHNICAL FIELD

The present invention relates to a hot rolling device, and a device and a method for continuous casting and hot rolling. More particularly, the present invention relates to a technique that improves the quality of a hot-rolled product by repeated heating at multiple points to evenly heat a cast part prior to being provided to a hot roller, and prevents a decrease in quality of a steel sheet and a reduction in a yield percentage that occur when switching to a continuous or a discontinuous hot rolling mode.

BACKGROUND ART

A process of performing hot rolling using a high temperature solidified cast part in a continuous casting device is currently widely used, due to equipment costs and operating costs thereof being more inexpensive than those of conventional equipment and processes.

Also, a discontinuous process capable of performing hot rolling separately from continuous casting, while continuously undertaking continuous casting and the hot rolling can also be performed. This discontinuous process is disclosed in detail in published Korean Patent No. 1990-7001437.

That is, as illustrated in FIGS. 1A and 1B, a continuous hot rolling mode of continuously performing continuous casting and hot rolling, and a discontinuous hot rolling mode of discontinuously performing continuous casting and hot rolling can be used, respectively.

Here, FIG. 1A illustrates a facility 1' capable of performing continuous hot rolling. When a cast part 2' having a constant thickness is generated in a continuous casting device 100', the cast part 2' is first hot-rolled in a first hot-rolling unit 210', the temperature is retained in a heat insulating means 320', and a steel sheet 2*a*' that presses the cast part 2' down is heated by heaters 310' to a temperature for hot-rolling to finish the final hot rolling in a second hot rolling section 220. The steel sheet 2*a*', after finishing hot rolling, is cut with a third cutter 430' and wound with a rewinder R to produce a hot-rolled steel sheet 2*a'*.

Meanwhile, FIG. 1B illustrates facility 1' capable of performing discontinuous hot rolling. When the cast part 2' having a constant thickness is produced in the continuous casting device 100', the cast part 2' is first hot-rolled in the first hot-rolling unit 210' and is cut with the first cutter 411' before moving to the heat insulating means 320', thereby performing hot rolling without being restricted to the casting speed of the continuous casting device 100'.

Here, the cutting steel sheet 2*a*' provided by cutting the steel sheet 2*a*' that presses the cast part 2' down is wound, and is then provided to finish the final hot rolling in the second hot rolling section 220' again. After being heated by the heater 310' to the temperature for hot-rolling, the cutting steel sheet 2*a*' is finally hot-rolled, is wound by the rewinder R and is produced as a hot-rolled steel sheet 2*a'*.

However, when performing such a hot-rolling process, since the hot rolling is performed by the first hot rolling section 210' in a state in which the temperature distribution of the cast part 2' provided by being produced in the continuous casting device 100' is uneven, there may be a problem of a reduction in the quality of the hot-rolled steel sheet 2*a'*.

Further, in the case of switching from the discontinuous hot rolling mode to the continuous hot rolling mode, when the cast part 2 provided by being produced in the continuous casting device 100' is depressed into the first hot rolling section 210', the speed of the continuous casting device 100' is restricted, thereby causing a problem of forming a strap on the cast part 2'.

To solve this problem, conventionally, the hot rolling process has been sequentially performed by gradually reducing an interval between top and bottom rolls of a plurality of hot rolling rolls of the first hot rolling section 210'. However, a transition zone in which the thickness is reduced has been generated at a tip portion of the sequentially hot-rolled steel sheet 2*a*', thereby causing another problem of lowering the quality of the produced hot-rolled steel sheet 2*a'*.

Therefore, there is a need for research into a hot rolling apparatus, and an apparatus and a method for continuous casting and hot rolling to solve the above-mentioned problems.

DISCLOSURE

Technical Problem

An aspect of the present invention provides a hot rolling apparatus, and an apparatus and a method for continuous casting and hot rolling that improve the quality of a hot-rolled steel sheet by evenly heating the cast part produced in the continuous casting device and by transmitting the cast part to the hot roller, remove steel sheet defects generated when switching to the continuous or discontinuous hot rolling mode, and enhance yield percentage.

Technical Solution

According to an aspect of the present invention, there is provided a hot rolling apparatus that includes a cast part supply section producing a cast part, a hot roller receiving and hot-rolling the cast part, and disposed to be linked to the cast part supply section, and a heating unit disposed between the cast part supply section and the hot roller and provided to reheat an outer surface portion of the cast part in a thickness direction while latent heat from preheating is retained in a central portion in the thickness direction of the cast part.

Further, the cast part produced by the cast part supply section of the hot rolling apparatus according to an embodiment of the present invention is formed to have a thickness of 70 to 120 mm, and the heating unit may heat the outer surface portion of the cast part to a temperature of 1250° C. or less, thereby maintaining the average temperature in the thickness direction of the cast part at 1000° C. or higher.

Further, according to another aspect of the present invention, there is provided a continuous casting and hot rolling apparatus that includes a continuous casting device producing a cast part, a hot roller receiving and hot-rolling the cast part, and disposed to be linked to the continuous casting device, and a heating unit provided at a front end of the hot roller and evenly and repeatedly heating the cast part at a plurality of points.

Further, the heating unit of the continuous casting and hot rolling apparatus according to another aspect of the present invention may include a plurality of heaters, disposed to be dispersed in a transportation direction of the cast part.

Further, the heater of the continuous casting and hot rolling apparatus according to another aspect of the present invention may be disposed to be dispersed in a region in a length direction of the slab provided by cutting the cast part so that can be used in a discontinuous hot rolling mode.

Further, the heating unit of the continuous casting and hot rolling apparatus according to another aspect of the present invention may further include a heat insulating means provided between the plurality of adjacent heaters and provided to surround at least one surface of the cast part to heat-insulate the cast part.

Further, the heater of the continuous casting and hot rolling apparatus according to another aspect of the present invention may include an inductive coil connected to a power supply source and provided to heat the cast part.

Further, the heater of the continuous casting and hot rolling apparatus according to another aspect of the present invention may further include a front-rear transport section connected to the induction coil to move the induction coil in the transportation direction of the cast part.

Also, the front-rear transport section of the continuous casting and hot rolling apparatus according to another aspect of the present invention may be provided to move the induction coil so as to be disposed at the same interval.

Moreover, the continuous casting and hot rolling apparatus according to another aspect of the present invention further includes a cutting and drawing unit provided with a cutter for cutting portions of the cast part, and a drawer for removing the cut portions of the cast part, the hot roller includes a first hot rolling section provided to be connected to the rear end of the continuous casting device, and a second hot rolling section provided to be connected to the rear end of the first hot rolling section, and the cutting and drawing unit may be provided between the first hot rolling section and the second hot rolling section.

Further, the cutting and drawing unit of the continuous casting and hot rolling apparatus according to another aspect of the present invention may also be provided at the front end of the heating unit.

Further, the hot roller of the continuous casting and hot rolling device according to another aspect of the present invention includes a first hot rolling section provided to be connected to a rear end of the continuous casting device, and a second hot rolling section provided to be connected to the rear end of the first hot rolling section, and the heating unit may be provided between the first hot rolling section and the second hot rolling section.

According to another aspect of the present invention, there is provided a method for continuous casting and hot rolling that includes a continuous casting operation of producing a cast part, an even heating operation of repeatedly heating the cast part at multiple points in a transportation direction of the cast part, and a hot rolling operation of pressing the cast part down after the even heating operation.

Further, the method for continuous casting and hot rolling according to another embodiment of the present invention may further include a first cutting and drawing operation of cutting and removing a tip portion of the cast part discharged from the continuous casting device, in the initial continuous casting in which the continuous casting operation is started.

Further, the hot rolling operation of the method for continuous casting and hot rolling according to another aspect of the present invention includes a sequential hot rolling operation of pressing the cast part down using a plurality of pairs of rolling rolls, while gradually reducing the width, at the time of switching to the continuous hot rolling mode in which the cast part is continuously provided and hot-rolled from a discontinuous hot rolling mode in which the cast part produced in the continuous casting operation is provided as a cut slab and hot-rolled, and may further include a second cutting and drawing operation of cutting and removing a cast part portion formed after the sequential hot rolling operation and provided so that a thickness thereof is gradually reduced.

Advantageous Effects

According to a hot rolling apparatus, and an apparatus and a method for continuous casting and hot rolling of an aspect of the present invention, there is provided an effect capable of providing a cast part so as to be evenly hot-rolled and transmitted to the hot roller, by repeatedly heating the cast part produced in the continuous casting device at a plurality of points.

Thus, an effect in which a hot-rolled steel sheet of high quality is produced by being evenly hot-rolled in the hot roller may be realized.

Moreover, since the temperature range of the heating temperature is within a range in which oxidation or the like does not occur in the cast part, there is also an advantage capable of preventing scale from being generated on the cast part, while increasing the temperature for hot-rolling.

Meanwhile, an effect of removing the defect from the cast part with an uneven thickness that may be generated when switching from the discontinuous hot rolling mode to the continuous hot rolling mode, by providing the cutting and drawing unit between the first hot rolling section and the second hot rolling section of the hot roller can be realized, thereby improving the overall quality of a hot-rolled steel sheet.

Further, when providing the cutting and drawing unit at the front end of the first hot rolling section, there is also an advantage in that the overall quality of a hot-rolled steel sheet may be improved, by removing the abnormal cast part tip portion of the initial production of the continuous casting device.

DESCRIPTION OF DRAWINGS

FIGS. 1A and 1B are diagrams illustrating a conventional continuous casting and hot rolling apparatus.

FIG. 5 is a flowchart illustrating a method for continuous casting and hot rolling of the present invention.

BEST MODE

Figure 2:
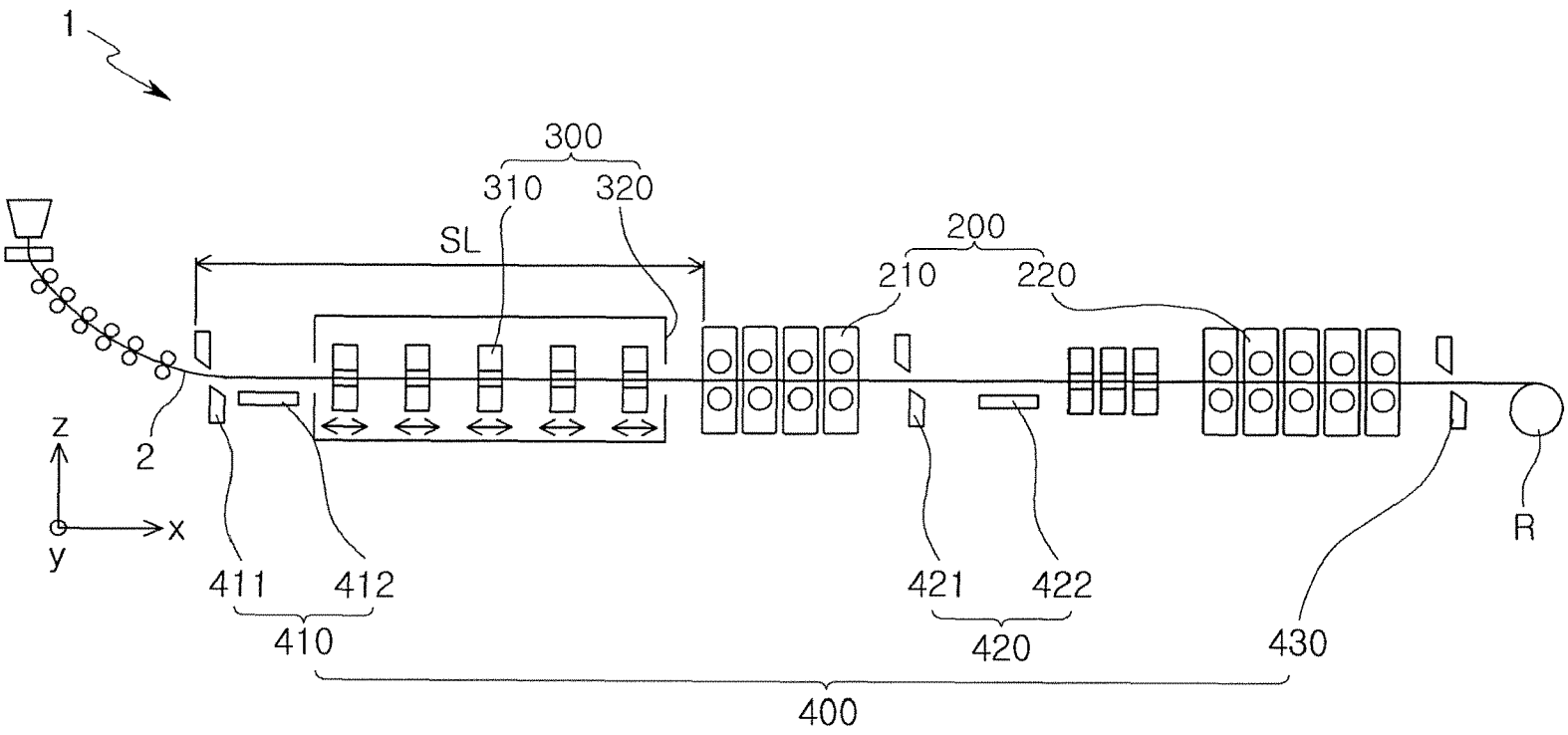
FIG. 2 is a side view illustrating a continuous casting and hot rolling apparatus of the present invention.

Hereinafter, embodiments of the invention will be described in detail with reference to the accompanying drawings. The drawings are attached hereto to help explain exemplary embodiments of the invention, and the present invention is not limited to the drawings and embodiments. In the drawings, some elements may be exaggerated, reduced in size, or omitted for clarity or conciseness.

The hot rolling apparatus and the apparatus and method for continuous casting and hot rolling of the present invention relate to an invention that improves the quality of a hot-rolled product by evenly heating a cast part 2 by repeated heating the cast part 2 at multiple points prior to being provided to a hot roller 200, and prevents a decrease in quality of a steel sheet 2*a* and a reduction in a yield percentage that may occur when switching to a continuous or a discontinuous hot rolling mode.

Thus, it is possible to produce a high-quality hot-rolled steel sheet 2*a* by even hot-rolling the cast part 2 in the hot roller 200.

Meanwhile, by providing a cutting and drawing unit 400 between a first hot rolling section 210 and a second hot rolling section 220 of the hot roller 200, it is possible to remove a defective steel sheet 2*a* with an uneven thickness that may be generated when switching from the discontinuous hot rolling mode to the continuous hot rolling mode, thereby improving the overall quality of the hot-rolled steel sheet 2.

Further, when the cutting and drawing unit 400 is provided at the front end of the first hot rolling section 210, even by removing the tip portion of the abnormal cast part 2 from the initial production of a continuous casting device 100, the overall quality of the steel sheet 2*a* may be improved.

Figure 3:
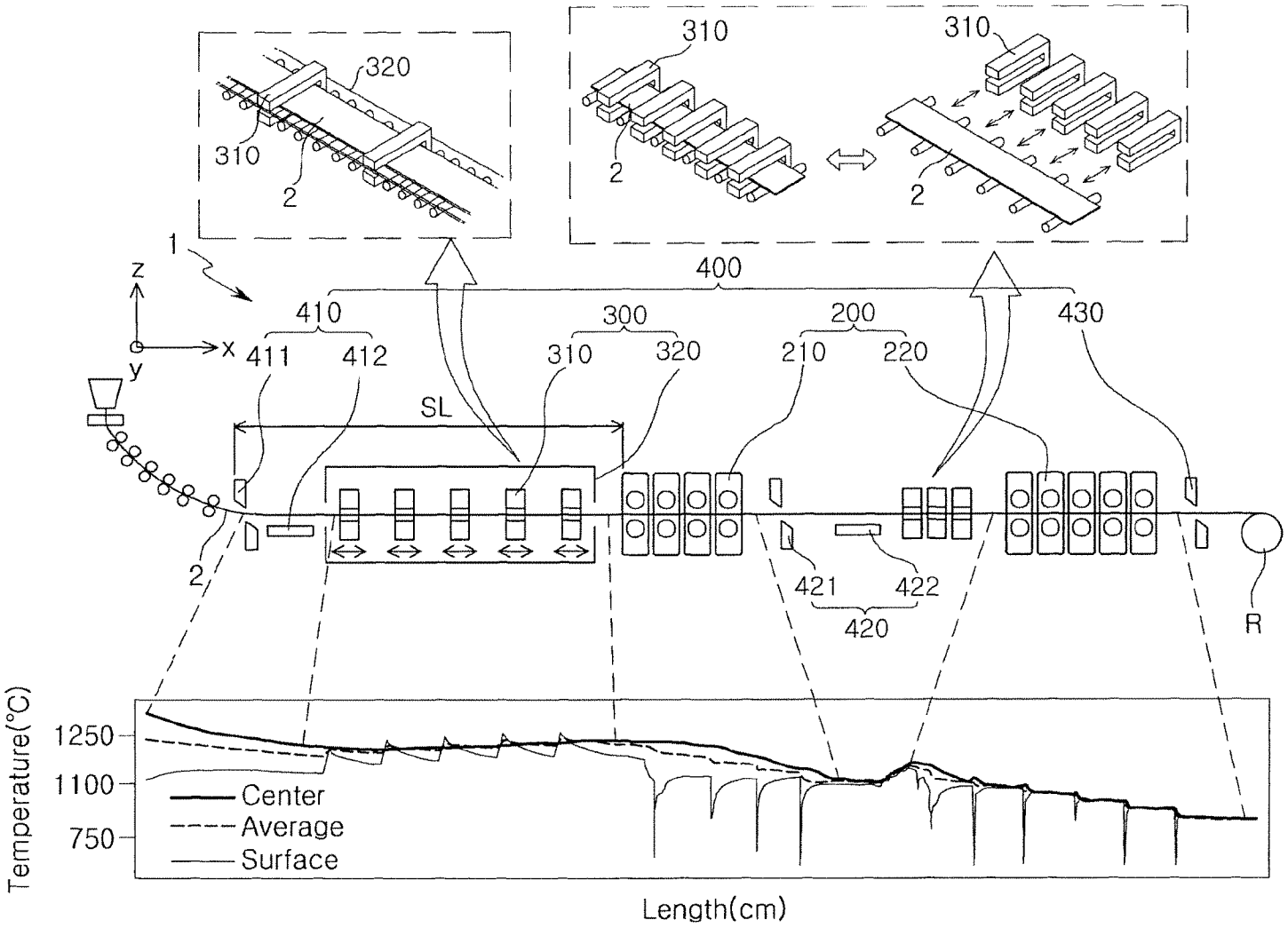
FIG. 3 is a diagram and a graph illustrating a temperature change of a cast part and a steel sheet depending on positions of the continuous casting and hot rolling apparatus of the present invention.

Specifically, FIG. 2 is a side view illustrating the continuous casting and hot rolling apparatus 1 of the present invention, and FIG. 3 is a diagram and a graph illustrating the temperature change of the cast part 2 and the steel sheet 2*a* depending on the positions of the continuous casting and hot rolling apparatus of the present invention. That is, in FIG. 3, it is possible to check the effect of even heating, by allowing a graph of temperature change and the position of the continuous casting and hot rolling apparatus of the present invention 1 to correspond to each other.

Referring to FIGS. 2 and 3, the hot rolling apparatus according to an embodiment of the present invention may include a cast part supply section that produces the cast part 2, the hot roller 200 receiving and hot-rolling the cast part, and disposed to be linked to the cast part supply section, and a heating unit 300 disposed between the cast part supply section and the hot roller 200, and provided to reheat an outer surface in a thickness direction z of the cast part 2, while latent heat is maintained in the central portion in the thickness direction z of the cast part 2 by preheating.

Further, the cast part 2 produced in the cast part supply section of the hot rolling apparatus according to an embodiment of the present invention is formed to have a thickness of 70 to 120 mm, and the heating unit 300 heats an outer surface portion of the cast part 2 to a temperature of 1250° C. or less to allow an average temperature in the thickness direction z of the cast part to be 1000° C. or higher.

Further, a continuous casting and hot rolling apparatus 1 according to another embodiment of the present invention that includes the continuous casting device 100 producing the cast part 2, the hot roller 200 receiving and hot-rolling the cast part 2, and disposed to be linked to the continuous casting device 100, and a heating unit 300 provided at a front end of the hot roller 200 and evenly and repeatedly heating the cast part 2 at a plurality of points.

Further, the heating unit 300 of the continuous casting and hot rolling apparatus 1 according to another embodiment of the present invention may include a plurality of heaters 310 which are disposed to be dispersed in a transportation direction x of the cast part 2.

Further, the heater 310 of the continuous casting and hot rolling apparatus 1 according to another embodiment of the present invention may be disposed to be dispersed in a region corresponding to the length SL of the slab provided by cutting the cast part 2 so that it is used in a discontinuous hot rolling mode.

Further, the heating unit 300 of the continuous casting and hot rolling apparatus 1 according to another embodiment of the present invention may further include a heat insulating means 320 provided between the plurality of adjacent heaters 310 and provided to surround at least one surface of the cast part 2 to heat-insulate the cast part 2.

Moreover, the continuous casting and hot rolling apparatus 1 according to another embodiment of the present invention further includes a cutting and drawing unit 400 provided with a cutter for cutting portions of the cast part, and a drawer for removing the cut portions of the cast part 2, the hot roller 200 includes a first hot rolling section 210 provided to be connected to a rear end of the continuous casting device 100, and a second hot rolling section 220 provided to be connected to a rear end of the first hot rolling section 210, and the cutting and drawing unit 400 may be provided between the first hot rolling section 210 and the second hot rolling section 220.

Further, the cutting and drawing unit 400 of the continuous casting and hot rolling apparatus 1 according to another embodiment of the present invention may also be provided at the front end of the heating unit 300.

Further, the hot roller 200 of the continuous casting and hot rolling apparatus 1 according to another aspect of the present invention includes a first hot rolling section 210 provided to be connected to a rear end of the continuous casting device 100, and a second hot rolling section 220 provided to be connected to the rear end of the first hot rolling section 210, and the heating unit 300 may be provided between the first hot rolling section 210 and the second hot rolling section 220.

The cast part supply section serves to supply the cast part 2 to the hot roller 200 and can be provided to produce the cast part 2 for this purpose.

Here, the cast part 2 can be provided as a slab with a thickness of 70 to 120 mm, and particularly, as an embodiment, the cast part supply section can be provided as the continuous casting device 100 in the continuous casting and hot rolling process. That is, the following description of the continuous casting device 100 may be a description of the cast part supply section.

The continuous casting device 100 can serve to produce the cast part 2 from the molten steel through the casting process. That is, the continuous casting device 100 supplies the molten steel to a mold from a tundish, and the supplied molten steel forms the cast part 2, while being deprived of quantity of heat, and the cast part 2 is guided and moved by a segment roll and a pinch roll and can be supplied to the hot roller 200 to be described later.

However, because the continuous casting device 100 produces the cast part 2 depending on the solidification rate of the molten steel, it is difficult to adjust the production rate. Therefore, when continuously receiving the cast part 2 produced by the continuous casting device 100 and pressing by the hot roller 200 to be described later to produce the hot-rolled steel sheet 2*a*, there is a limitation in terms of speed.

Meanwhile, when the cast part 2 produced by the continuous casting device 100 is discontinuously provided to the hot roller 200 to produce the hot-rolled steel sheet 2*a*, the hot roller 200 can rapidly perform the hot-rolling operation independently of the production speed of the continuous casting device 100 to produce a hot-rolled steel sheet 2*a*.

In this manner, the process of producing the cast part 2 produced by the continuous casting device 100 into the hot-rolled steel sheet 2*a* by the hot roller 200 can be distinguished by a continuous hot rolling mode and a discontinuous hot rolling mode, and the hot-rolling operation can be performed, while varying the hot rolling production modes.

However, when varying the operation modes, there is a problem of a degradation of the quality of the hot-rolled steel sheet 2*a*. The cutting and drawing unit 400 can be provided in the present invention in order to solve this problem, and this will be described later in the description of the cutting and drawing unit 400.

Also, there is also a problem of a degradation of the quality of the hot-rolled steel sheet 2*a* in the initial production of the continuous casting device 100, and this will also be described later in the description of the cutting and drawing unit 400.

The hot roller 200 can serve to receive the cast part 2 produced by the continuous casting device 100 and to press the case slab 2, thereby producing the hot-rolled steel sheet 2*a*. To this end, the hot roller 200 can press the cast part 2, while causing the cast part 2 to pass between a pair of hot-rolling rolls, and a plurality of pairs of hot-rolling rolls can be provided.

Furthermore, the hot roller 200 can be distinctively provided in a first hot rolling section 210 or a second hot rolling section 220, depending on the positions available.

Here, the first hot rolling section 210 is the hot roller 200 provided to be connected to the rear end as an output side of the continuous casting device 100, and produces the hot-rolled steel sheet 2*a* in cooperation with the second hot rolling section 220 in the continuous hot rolling mode. That is, because the hot-rolling process is performed in the continuous hot rolling mode, by utilizing the cast part 2 connected to the continuous casting device 100, when suddenly performing the hot-rolling, the continuous casting device 100 is influenced. Thus, a first hot-rolled steel sheet 2*a* having a constant thickness is produced in the first hot rolling section 210, and the completed second rolled steel sheet 2*a* is produced in the second hot rolling section 220.

However, the first hot rolling section 210 can also produce the hot-rolled steel sheet 2*a* in the discontinuous hot rolling mode in cooperation with the second hot rolling section 220, without being limited only to being used in the continuous hot rolling mode.

In particular, the first hot rolling section 210 performs a sequential rolling operation, at the time of transition from the discontinuous hot rolling mode to the continuous hot rolling mode. That is, the hot-rolling operation is initially performed using the cut cast part (slab: 2) provided by cutting the cast part 2 in the discontinuous hot rolling mode, and then, after transition to the continuous hot rolling mode, the first hot rolling section 210 continuously receives the provision of the cast part 2 produced in the continuous casting device 100. At this time, when the first hot rolling section 210 suddenly presses down the cast part 2, the continuous casting device 100 is influenced. In this case, a strap is generated, while the cast part 2 is pushed, thereby causing defects on the cast part 2.

To prevent these defects, the first hot rolling section 210 sequentially reduces a gap between the pair of hot-rolling rolls to perform the sequential hot-rolling when switching from the discontinuous hot rolling mode to the continuous hot rolling mode.

However, when performing such a sequential hot-rolling, a steel sheet 2*a* including a thickness transition zone in which the thickness of the first hot-rolled steel sheet 2*a* produced by the first hot rolling section 210 is gradually reduced is produced, which degrades the quality of the hot-rolled steel sheet 2*a*. In order to remove such defective steel sheet 2*a*, a cutting and drawing means can be provided in the present invention, and a detailed description thereof will be provided later in the description of the cutting and drawing unit 400.

Meanwhile, the first hot rolling section 210 receives the cast part 2 produced by the continuous casting device 100 to produce the first hot-rolled steel sheet 2*a*. At this time, because the cast part 2 provided by being produced in the continuous casting device 100 is provided in a state of an uneven temperature distribution in the thickness direction z of the order cast part 2, the quality of the produced hot-rolled steel sheet 2*a* is degraded. To solve this problem, the present invention provides a heating unit 300, and a description of the heating unit 300 will be provided later.

The second hot rolling section 220 can serve to directly receive the first hot-rolled steel sheet 2*a* produced in the first hot rolling section 210 or the cast part 2 produced in the continuous casting device 100, and to produce a final second rolled steel sheet 2*a*. The second hot rolling section 220 also presses down the cast part 2 moved between a pair of hot-rolling rolls to produce the hot-rolled steel sheet 2*a*, and the hot-rolled steel sheet 2*a* thus produced is wound around a rewinder R and is finally discharged.

To this end, the second hot rolling section 220 can be provided to be connected to a rear end as an output side of the first hot rolling section 210, and the cutting and drawing unit 400 or the like can be provided between the second hot rolling section 220 and the first hot rolling section 210.

The heating unit 300 can serve to evenly heat the cast part 2 provided by being produced in the continuous casting device 100 and to provide it to the hot roller 200. That is, the heating unit 300 is provided between the rear end as the output side of the continuous casting device 100 and the front side as the input side of the hot roller 200, and can be provided to form an even temperature distribution in the thickness direction z of the cast part 2, by repetitive heating in a plurality of points.

In addition, the heating unit 300 may also be provided between the first hot rolling section 210 and the second hot rolling section 220. That is, even after the first hot rolling section 210 is formed into the cast part 2 by the first hot-rolled steel sheet 2*a*, since it may be necessary to raise the temperature for hot-rolling using the second hot rolling section 220, the heating unit 300 can also be provided in the first hot rolling section 210 and the second hot rolling section 220.

Here, when the cast part 2 is generally heated only once, due to the short heating time, in the process of the heat transferred to the surface of the cast part 2 being transferred to the center of the cast part 2, the surface of the cast part 2 is cooled. At the time when the cast part 2 is transferred to the hot roller 200, an uneven temperature distribution is formed in the thickness direction z of the cast part 2, and the hot rolling is performed using the cast part 2 of the uneven temperature distribution.

However, because heating is performed at a plurality of points before transferring the cast part 2 to the hot roller 200 in the present invention, the time being provided to the even temperature distribution increases, and the hot roller 200 hot-rolls the cast part 2 of even temperature distribution. Accordingly, it is possible to produce a high-quality hot-rolled steel sheet 2*a*.

That is, by performing heating on the surface of the cast part 2, and by re-heating the surface of the cast part 2 during the time when heat is transferred to the center of the cast part 2, it is possible to extend the time at which the cast part 2 is distributed at an even temperature in the thickness direction z.

Furthermore, when repeating this process, it is possible to increase the time of such an even temperature distribution, and the evenly heated cast part 2 is transmitted to the hot roller 200 and is provided at an even temperature distribution even during the pressed-down time, and it is possible to produce a high-quality hot-rolled steel sheet 2*a*.

In this manner, the even heating of the cast part 2 can be determined due to the fact that the cast part 2 is provided to reheat the outer surface in the thickness direction z of the cast part 2, while latent heat is maintained at the central portion in the thickness direction z of the cast part 2 by preheating.

That is, when heat is transferred to the outer surface portion as the surface of the cast part 2 by preheating, the heat is conducted and transferred to the central portion as an intermediate portion in the thickness direction z of the cast part 2. The outer surface portion is cooled during the time when heat is conducted, and an uneven temperature distribution is generated.

At this time, the outer surface portion is reheated again for the even temperature distribution. However, such reheating needs to be performed before the central portion is cooled, in order to allow the average temperature of the cast part 2 to rise at the even temperature distribution.

Further, the temperature for heating the outer surface portion is desirably limited to a temperature at which the outer surface portion is not oxidized in order to improve the quality of the final hot-rolled steel sheet 2*a*. That is, it is desirable to heat the outer surface portion to about 1250° C. or less in order to prevent an occurrence of scale caused by oxidation. In addition, heating to the temperature of 1500° C. or higher is less desirable because this temperature is close to the melting point of the cast part 2.

Meanwhile, it is also desirable to provide a plurality of heaters 310 and perform repeated heating, in order to improve the temperature in the thickness direction z of the cast part 2 including the central portion, while the temperature of the outer surface portion is restricted.

According to this, since it is possible to set an average temperature in the thickness direction z of the cast part 2 including the central portion and the outer surface portion of the cast part 2 to 1000° C. or higher, preferably 1200° C. or higher, the average temperature can be provided as a temperature for hot-rolling.

In this manner, the heating unit 300 may provide a plurality of heaters 310 for repeatedly heating at a plurality of points. Since such heaters 310 are disposed to be dispersed in the transportation direction x of the cast part 2, the heaters can be provided to heat the cast part 2 a plurality of times, while the same portion of the cast part 2 is transferred.

Meanwhile, the heater 310 can be provided by being distributed in a region corresponding to the length SL of the slab, namely, the cut cast part 2 provided by cutting the cast part 2 in the discontinuous hot rolling mode. In such a case, by evenly heating the entire cut cast part 2 before being cut by the hot roller 200, it is possible to produce a high-quality hot-rolled steel sheet 2*a* even in a discontinuous hot rolling mode.

Here, the heater 310 can provide an induction coil 311 for heating the cast part 2, and in such a case, the heating temperature can be adjusted. This will be described later in detail with reference to FIG. 4.

Further, as a transport means for adjusting the distance between the plurality of the heaters 310 or disengaging the heater 310 in the transportation path of the cast part 2, a front-back transport section 312 and a left-right transport section 313 can be included. This will also be described later with reference to FIG. 4.

The heating unit 300 may further include a heat insulating means 320 to further extend the even temperature holding time of the cast part 2 that forms an even temperature region by the heater 310. That is, the heat insulating means 320 is provided to surround at least one surface of the cast part 2, and can serve to maintain the temperature of the cast part 2.

To this end, the thermal insulating means 320 can be provided in a portion between a plurality of the heaters 310. That is, in order to wrap the cast part 2, the heat insulating means 320 can be provided except for the portions in which the heaters 310 are provided.

Meanwhile, the heat insulating means 320 is desirably provided to wrap the cast part 2 in all circumferential directions thereof, for efficient thermal insulation, and in order to increase the thermal insulation ratio, the heat insulating means 320 may be provided to supply a heat-insulating gas.

Such a heat insulating means 320 can also be formed of refractory brick made of a ceramic-based material.

Meanwhile, the heat insulating means 320 may also be provided as a heat insulation holding furnace. That is, the heat insulating means 320 may also be provided inside the hest insulating means serving as a heat insulation holding furnace.

The cutting and drawing unit 400 may serve to cut and draw a part of the cast part 2. That is, the cutting and drawing unit 400 can serve to remove the defective cast part 2 or steel sheet 2*a* of the cast part 2 and the steel sheet 2*a* to the outside after cutting. To this end, the cutting and drawing unit 400 can include a cutter such as a first cutter 411, a second cutter 421 and a third cutter 430, and a drawer such as a first drawer 412 and a second drawer 422.

Meanwhile, a plurality of cutting and drawing units 400 can be provided in a plurality of positions, and can be provided as a first cutting and drawing section 410 provided at the rear end of the continuous casting device, and a second cutting and drawing section 420 provided between the first hot rolling section 210 and the second hot rolling section 220.

The first cutting and drawing section 410 may serve to remove the defective cast part 2 in the cast part 2 provided by being produced in the continuous casting device 100. That is, in the initial state of the continuous casting process using the continuous casting device 100, the defective cast part 2 having failed to reach the required condition is produced and discharged. When such a cast part 2 is transmitted to the hot roller 200 without change, the quality of the hot-rolled steel sheet 2*a* is significantly degraded.

Therefore, in order to remove such a defective cast part 2, the first cutting and drawing section 410 is provided at the rear end of the continuous casting device 100. That is, when the first cutter 411 of the first cutting and drawing section 410 first cuts the defective cast part 2, the first drawer 412 of the first cutting and drawing section 410 removes the cut defective cast part 2 to prevent it from being transmitted to the hot roller 200.

The second cutting and drawing section 420 is provided between the first hot rolling section 210 and the second hot rolling section 220, and can serve to remove a defective cast part 2 of the first hot-rolled steel sheet 2*a* discharged from the first hot rolling section 210.

That is, in a case where the first cutting drawer portion 410 is not provided, when the first hot rolling section 210 presses and provides the defective cast part 2 generated in the continuous casting device 100 in the initial continuous casting, the second cutting and drawing section 420 can serve to remove the defective steel sheet 2*a* provided by pressing the defective cast part 2 down.

In particular, the second cutting and drawing section 420 can improve the overall quality of the hot-rolled steel sheet 2*a* by removing the defective steel sheet 2*a* with the uneven thickness generated when switching from the discontinuous hot rolling mode to the continuous hot rolling mode.

To this end, the second cutting and drawing section 420 can also provide a second cutter 421 for cutting the defective steel sheet 2*a*, and a second drawer 422 for removing the cut defective steel sheet 2*a*.

Meanwhile, the cutting and drawing unit 400 can also include a third cutter 430 provided at the rear end as the output side of the second hot rolling section 220 so as to cut the coil steel sheet 2*a* produced in the continuous hot rolling mode.

Figure 4:
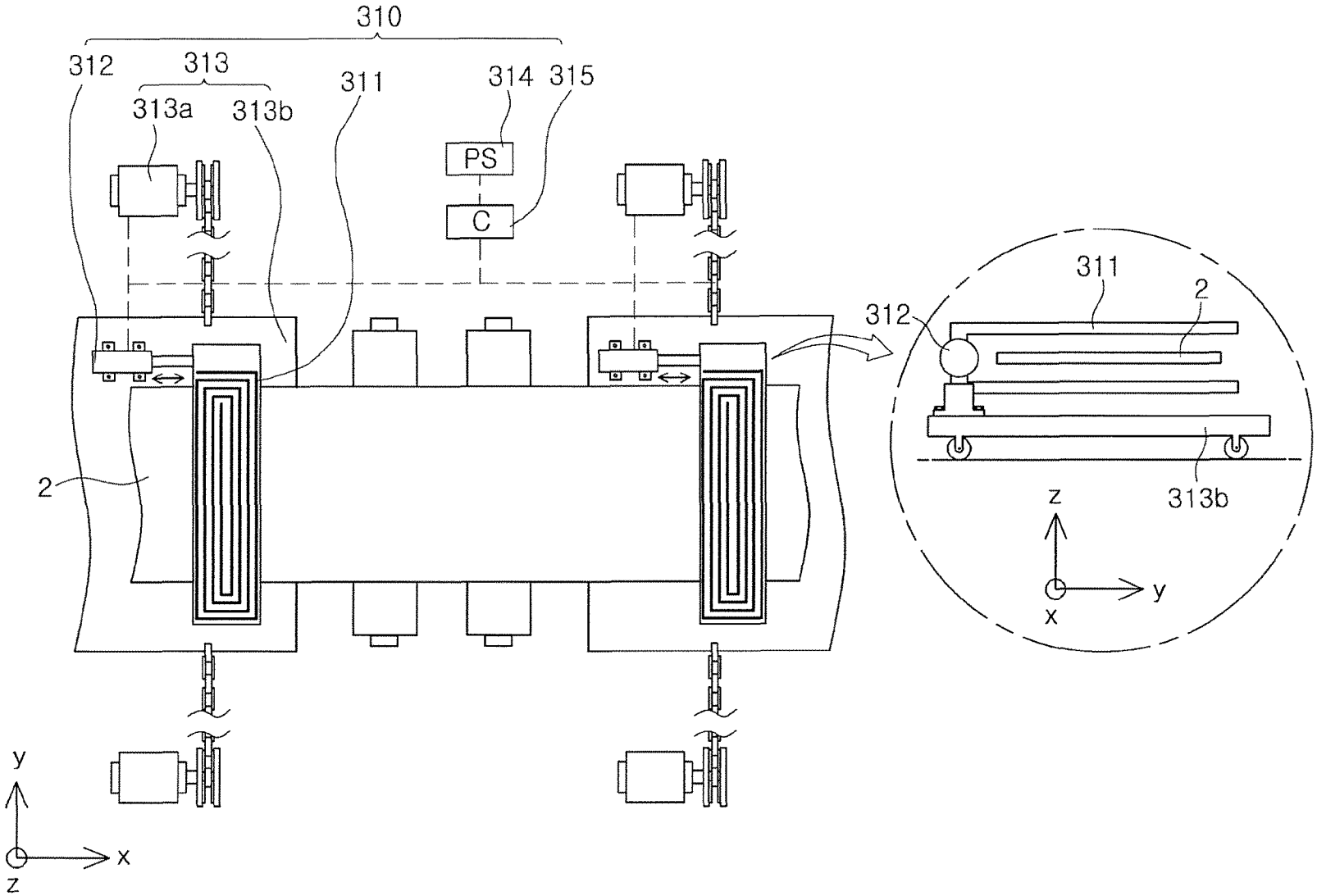
FIG. 4 is a plan view illustrating a heating unit in the continuous casting and hot rolling apparatus of the present invention.

FIG. 4 is a plan view illustrating the heating unit 300 in the continuous casting and hot rolling apparatus 1 of the present invention. Referring to FIG. 4, the heater 310 of the continuous casting and hot rolling apparatus 1 according to another embodiment of the present invention may include an induction coil 311 connected to a power supply source 315 to heat the cast part 2.

Further, the heater 310 of the continuous casting and hot rolling apparatus 1 according to another embodiment of the present invention can further include a front-back transport section 312 connected to the induction coil 311 so as to move the induction coil 311 in the transportation direction x of the cast part 2.

Further, the front-back transport section 312 of the continuous casting and hot rolling apparatus 1 according to another embodiment of the present invention can provide the induction coil 311 by moving it so as to be arranged at the same interval.

That is, the heater 310 provides the induction coil 311 capable of being induction-heated, and can include the front-back transport section 312 or the like capable of setting the position of the heater 310.

Here, when the heater 310 is heated using the induction coil 311, although it is possible to adjust the temperature for heating the cast part 2. The heating amount may be differently set depending on the position at which the heater 310 is provided accordingly, and it may also be provided to gradually increase the heating amount.

However, when the heater 310 utilizes the induction coil 311, since the outer surface portion in the thickness direction z of the cast part 2 adjacent to the induction coil 311 has a magnetic flux greater than that of the central portion in the thickness z of the cast part 2, the outer surface portion generates much more heat and is heated more.

In this manner, in order to adjust the heating amount of the induction coil 311, the induction coil 311 may be connected to the power supply source 315, and a control unit 314 for control may be provided.

The adjustment of the heating amount of the induction coil 311 may also include the on/off function of the induction coil 311. That is, turning the induction coil 311 on or off can also be controlled by controlling whether or not to supply the power in the power supply source 315.

The induction coil 311 can be provided by winding the coil around the core for induction heating. The core can be provided in the width direction y of the cast part 2, and the coil can be provided by being wound around the core to be able to heat the cast part 2 in the overall width direction y thereof.

Meanwhile, the induction coil 311 may be provided on both of the upper and bottom surfaces of the cast part 2, is provided in a "U" shape for structural stability, and can also be provided so that the side surface of the cast part 2 is inserted.

The front-back transport section 312 can adjust the interval of the adjacent induction coil 311, while moving the induction coil 311 in the transportation direction x of the cast part 2. To this end, the front-back transport section 312 is provided to be connected to the induction coil 311 and may be provided as an oil pneumatic cylinder.

Further, in order to stably move the induction coil 311 provided long in the width direction y of the cast part 2 back and forth, an oil pneumatic cylinder of the front-back transport section 311 may be provided at each end portion of the induction coil 311.

Meanwhile, the front-back transfer 312 can be provided to be able to adjust the interval by being connected to the control unit 314, and by adjusting the interval between the adjacent induction coils 311, the induction coil 311 can be disposed at an interval with the highest even heating effect.

Thus, the induction coil 311 disposed by the front-back transport section 312 may also be provided to be disposed between the adjacent induction coils 311 at equal intervals, and in this case that, since the cast part 2 is heated at the same interval, it is possible to perform the temperature rise and the even heating at a constant rate, and it is possible to stably improve the even heating efficiency.

Further, the heater 310 may also include a left-light transport section 313 that can move the induction coil 311 in the width direction y of the cast part 2. That is, the induction coil 311 can be provided to be movable onto or to be removed from the transportation path of the cast part 2.

According to this, in order to heat the cast part 2, the induction coil 311 comprises cast part 2 can be provided to move to the top surface or the bottom surface of the cast part 2, and when not heating the cast part 2, the heater 310 is removed from the transportation path of the cast part 2 to prevent an occurrence of a problem such as collision with the cast part 2.

To this end, the left-right transport section 313 can provide a moving plate 313*b* provided with the front-back transport section 312 and the induction coil 311, and a motor 313*a* for driving the moving plate 313*b*. That is, the induction coil 311 and the front-back transport section 312 can be moved as a whole left and right. The moving plate 313*b* can be connected to the motor 313*a* through a chain, and the chain can move by receiving the transmission of the driving force by sprocket provided by the motor 313*a*.

However, the driving force for moving the moving plate 313*b* is not limited to being provided by the motor 313*a*, and the driving force may be transmitted by hydraulic or pneumatic cylinders.

Further, in order that the moving plate 313 is provided on the moving path of the cast part 2, a wheel may also be coupled to the bottom surface.

Meanwhile, a plurality of moving plates 313*b* may be provided by being spaced apart from each other to move the respective induction coils 311 while supporting the coils, and a moving roll for supporting the cast part 2 may be provided between the moving plates 313*b* spaced apart from each other.

FIG. 5 is a flowchart illustrating the method for continuous casting and hot rolling of the present invention. Referring to FIG. 5, the continuous casting and hot rolling method according to another embodiment of the present invention may include a continuous casting operation of producing a cast part 2, an even heating operation of repeatedly heating the cast part 2 at multiple points in a transportation direction x of the cast part 2, and a hot rolling operation of pressing the cast part down after the even heating operation.

Further, the method for continuous casting and hot rolling according to another embodiment of the present invention may further include a first cutting and drawing operation of cutting and removing a tip portion of the cast part 2 discharged from the continuous casting device 100, in the initial continuous casting in which the continuous casting operation is started.

Further, the hot rolling operation of the method for continuous casting and hot rolling according to another aspect of the present invention includes a sequential hot rolling operation of pressing the cast part 2 down using a plurality of pairs of rolling rolls, while gradually reducing the width, at the time of switching to the continuous hot rolling mode in which the cast part 2 is continuously provided and hot-rolled from a discontinuous hot rolling mode in which the cast part 2 produced in the continuous casting operation is provided as a cut slab and hot-rolled, and may further include a second cutting and drawing operation of cutting and removing the cast part 2 portion formed after the sequential hot rolling operation and provided so that a thickness thereof is gradually reduced.

The continuous casting operation is a operation of generating the cast part 2 by the continuous casting device 100, and provides the cast part 2 by receiving the molten steel by the continuous casting. At the initial continuous casting, a defective cast part 2 may fail to reach the required state. However, this may be cut and removed by the cutting and drawing unit 400 connected to the rear end of the continuous casting device 100 at the first cutting and drawing operation.

The even heating operation is a operation for generating a cast part 2 with an excellent quality, by evenly heating the cast part and transmitting it to the hot roller 200. To this end, the cast part 2 can have an even temperature distribution, by being repeatedly heated at a plurality of points through the heating unit 300.

Such an even heating operation needs to be performed prior to a hot rolling operation to be described later to improve the quality of the hot-rolled steel sheet 2*a* produced by pressing the cast part 2 down. That is, it is desirable to perform the even heating operation prior to the first hot rolling operation, the second hot rolling operation and the sequential hot rolling operation of the hot rolling operation to be described later in order to improve the quality of the hot-rolled steel sheet 2*a*.

The hot rolling operation is a operation of receiving the cast part 2 produced in the continuous casting operation and pressing the cast part down to produce a hot-rolled steel sheet 2*a*. It is desirable to perform the hot rolling operation after passing through the even heating operation in order to produce a hot-rolled steel sheet 2*a* with an excellent quality.

Here, in the hot rolling operation, the cast part can be pressed down separately into the first hot rolling operation and the second hot rolling operation to prevent an influence on the continuous casting device 100 in the continuous hot rolling mode of receiving the cast part 2 produced in the continuous casting operation and producing the hot-rolled steel sheet 2*a*.

That is, the first hot rolling operation is a operation provided by pressing the cast part down to form only the thickness of the constant portion, before forming the final thickness of the hot-rolled steel sheet 2*a*, and the second hot rolling operation is a operation of producing a final second hot-rolled steel sheet 2*a*, by pressing down the first hot-rolled steel sheet 2*a* after passing through the first hot rolling operation.

The first hot rolling operation is performed after the continuous casting operation, and the second hot rolling operation can be performed after the first hot rolling operation. However, in order to improve the quality of the hot-rolled steel sheet 2*a*, the even heating operation can be performed between the continuous casting operation, the can be performed during the first hot rolling operation and the first hot rolling operation, and can also be performed between the first hot rolling operation and the second hot rolling operation.

Here, the even heating operation between the first hot rolling operation and the second hot rolling operation can be defined as an additional heating operation, since the meaning of additional heating is present.

Meanwhile, the cast part 2 having failed to reach the requested state is produced in the initial continuous casting, the first cutting and drawing operation of removing the defective cast part 2 can be performed, and such a first cutting and drawing operation can be performed by determining whether there is initial continuous casting.

When the first cutting and drawing operation is performed, the first cutter 411 provided at the rear end of the continuous casting device 100 is operated to cut a defective tip portion produced in the continuous casting device 100, and thereafter, the cut defective cast part 2 is drawn and removed to the outside by the first drawer 412.

In addition, the method for continuous casting and hot rolling of the present invention may be performed, while changing the production mode to the continuous hot rolling mode and the discontinuous hot rolling mode. There is no problem at the time of the change from the continuous hot rolling mode to the discontinuous hot rolling mode. However, at the time of the change from the discontinuous hot rolling mode to the continuous hot rolling mode, since the continuous casting device 100 may be affected, a special operation can be performed.

That is, when the cast part 2 provided by being continuously produced by the continuous casting device 100 is suddenly pressed down by the hot roller 200, due to a decrease in thickness, the production rate of the continuous casting device 100 suddenly becomes slower and the cast part 2 is pushed, and a strap may be generated on the cast part 2 accordingly.

In order to prevent an occurrence of the strap, a sequential hot rolling operation is provided in the hot rolling operation. That is, by performing hot rolling, while reducing a gap of the rolling roll pair of the first hot rolling section 210, it is possible to prevent an impact from being applied to the continuous casting device 100.

However, a steel 2*a* in which a thickness transition portion having a gradually decreasing thickness exists is produced in such a continuous hot rolling operation, and since the portion of the steel sheet 2*a* degrades the quality when pressing down in the second hot rolling section 220, it is desirable to cut and remove the portion.

To this end, the second cutting and drawing operation can be performed after the sequential hot rolling operation. The second cutting and drawing operation cuts the portion of the defective steel sheet 2*a* discharged from the first hot rolling section 210 using the second cutter 421, and the cut defective steel sheet 2*a* is discharged to the outside from the second drawer 422 to improve the overall quality of hot-rolled steel sheet 2*a*.

Meanwhile, since the hot-rolled steel sheet 2*a* is produced so as not to include such a defective steel sheet 2*a*, it is possible to prevent a problem in which an overall coil steel sheet 2*a* produced by some of defective steel sheet 2*a*.

The invention claimed is:

1. A hot rolling apparatus comprising:

a cast part supply section producing a cast part;

a hot roller receiving and hot-rolling the cast part, and disposed to be linked to the cast part supply section; and a heating unit disposed between the cast part supply section and the hot roller, wherein the heating unit comprises a plurality of heaters that are dispersed to be spaced apart from each other in a transportation direction of the cast part, and wherein one heater among the plurality of heaters is disposed to reheat an outer surface portion of the cast part in a thickness direction, while another heater among the plurality of heaters preheats to retain latent heat in a central portion of the cast part in the thickness direction.

2. The hot rolling apparatus of claim 1, wherein the cast part produced by the cast part supply section is formed to have a thickness of 70 to 120 mm, and the heating unit heats the outer surface portion of the cast part to a temperature of 1250.degree. C. or less, thereby allowing an average temperature in the thickness direction of the cast part to be 1000.degree. C. or higher.

3. A continuous casting and hot rolling apparatus comprising:

a continuous casting device producing a cast part;

a hot roller receiving and hot-rolling the cast part, and disposed to be linked to the continuous casting device; and a heating unit provided at a front end of the hot roller, wherein the heating unit comprises a plurality of heaters that are dispersed to be spaced apart from each other in a transportation direction of the cast part, and wherein one heater among the plurality of heaters is disposed to reheat an outer surface portion of the cast part in a thickness direction, while another heater among the plurality of heaters preheats to retain latent heat in a central portion of the cast part in the thickness direction.

4. The continuous casting and hot rolling apparatus of claim 3, wherein the heaters are disposed to be dispersed in a region corresponding to a length of a slab provided by cutting the cast part so that the heaters are used in a discontinuous hot rolling mode.

5. The continuous casting and hot rolling apparatus of claim 4, wherein the heating unit further comprises a heat insulating means provided between the plurality of adjacent heaters and provided to surround at least one surface of the cast part to heat-insulate the cast part.

6. The continuous casting and hot rolling apparatus of claim 3, wherein the heater comprises an inductive coil connected to a power supply source and provided to heat the cast part.

7. The continuous casting and hot rolling apparatus of claim 6, wherein the heater further comprises a front-rear transport section connected to the induction coil to move the induction coil in the transportation direction of the cast part.

8. The continuous casting and hot rolling apparatus of claim 7, wherein the front-rear transport section is provided to move the induction coil so as to be disposed at the same interval.

9. The continuous casting and hot rolling apparatus of claim 3, further comprising:

a cutting and drawing unit provided with a cutter for cutting portions of the cast part, and a drawer for removing the cut portions of the cast part, wherein the hot roller comprises a first hot rolling section provided to be connected to a rear end of the continuous casting device; and a second hot rolling section provided to be connected to the rear end of the first hot rolling section, and the cutting and drawing unit is provided between the first hot rolling section and the second hot rolling section.

10. The continuous casting and hot rolling apparatus of claim 9, wherein the cutting and drawing unit is also provided at a front end of the heating unit.

11. The continuous casting and hot rolling apparatus of claim 3, wherein the hot roller comprises:

a first hot rolling section provided to be connected to a rear end of the continuous casting device; and a second hot rolling section provided to be connected to the rear end of the first hot rolling section, and the heating unit is provided between the first hot rolling section and the second hot rolling section.

12. A method for continuous casting and hot rolling, the method comprising:

a continuous casting operation of producing a cast part;

an even heating operation of heating the cast part at multiple points in a transportation direction of the cast part by a heating unit; and a hot rolling operation of pressing the cast part down after the even heating operation, wherein the heating unit comprises a plurality of heaters that are dispersed to be spaced apart from each other in a transportation direction of the cast part, and wherein one heater among the plurality of heaters is disposed to reheat an outer surface portion of the cast part in a thickness direction, while another heater among the plurality of heaters preheats to retain latent heat in a central portion of the cast part in the thickness direction.

13. The method of claim 12, further comprising:

a first cutting and drawing operation of cutting and removing a tip portion of the cast part discharged from the continuous casting device, in the initial continuous casting in which the continuous casting operation is started.

14. The method of claim 12, wherein the hot rolling operation comprises a sequential hot rolling operation of pressing the cast part down using a plurality of pairs of rolling rolls, while gradually reducing the width, at the time of switching to the continuous hot rolling mode in which the cast part is continuously provided and hot-rolled from a discontinuous hot rolling mode in which the cast part produced in the continuous casting operation is provided as a cut slab and hot-rolled, and the method further comprising:

a second cutting and drawing operation of cutting and removing a cast part portion formed after the sequential hot rolling operation and provided so that a thickness thereof is gradually reduced.

* * * * *